US006239397B1

(12) United States Patent
Rosenbaum et al.

(10) Patent No.: US 6,239,397 B1
(45) Date of Patent: May 29, 2001

(54) PROCESS FOR SORTING MAILINGS

(75) Inventors: Walter Rosenbaum, Paris (FR); Ottmar Kechel, Stockach; Boris Lohmann, Bremen, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/319,785

(22) PCT Filed: Dec. 1, 1997

(86) PCT No.: PCT/DE97/02803

§ 371 Date: Aug. 20, 1999

§ 102(e) Date: Aug. 20, 1999

(87) PCT Pub. No.: WO98/24564

PCT Pub. Date: Jun. 11, 1998

(30) Foreign Application Priority Data

Dec. 7, 1996 (DE) ..... 196 50 875
Mar. 15, 1997 (DE) ..... 197 05 891

(51) Int. Cl.[7] ..... B07C 5/00

(52) U.S. Cl. ..... 209/584; 209/576; 209/44.1; 209/3; 209/3.1; 209/3.3

(58) Field of Search ..... 209/3, 3.1, 3.3, 209/44.1, 576, 584; 705/28, 29

(56) References Cited

U.S. PATENT DOCUMENTS 5,419,440 5/1995 Picoult ..... 209/583

FOREIGN PATENT DOCUMENTS 34 23 514 A1 1/1985 (DE) ..... B07C/5/342
44 07 559 A1 11/1995 (DE) ..... B07C/7/04
196 50 875 C1 10/1997 (DE) ..... B07C/3/02
0 227 569 A1 7/1987 (EP) ..... B07C/3/00
0 586 883 A2 3/1994 (EP) .
0 661 105 A2 7/1995 (EP) ..... B07C/3/00
0 661 105 A2 * 12/1994 (JP) ..... B07C/3/00

* cited by examiner

*Primary Examiner*—Donald P. Walsh
*Assistant Examiner*—Mark J. Beauchaine
(74) *Attorney, Agent, or Firm*—Venable; Norman N. Kunitz

(57) ABSTRACT

A process of the type disclosed according to DE 196 50 875 for sorting mailings having different properties by using sorting machines not suitable for all properties of the mailings. The unsuitable mailings receive an identification (ID) marking and their sensed distribution information is stored under this ID marking. As representing each non-processible mailing, a processible substitute is added to the stack of substitutes being assigned one of the non-processible mailings, in each case by means of an ID marking. Then, the processible mailings and the substitutes are sorted according to the associated distribution information. After sorting, the non-processible mailings are brought into a sequence appropriate for sorting on the basis of the ID markings located on them and the associated substitutes.

15 Claims, 3 Drawing Sheets

PROCESS FOR SORTING MAILINGS

BACKGROUND OF THE INVENTION

The invention relates to a process, of the type disclosed in DE-19650875, for sorting mailings having different properties using sorting machinery that sense the distribution information located on the mailings.

In the sorting of mailings, usually sorting machines which do not cover the entire spectrum of mailings to be processed with regard to size and weight (or other properties) are used. For instance, letter mailings are sorted on special letter-sorting machines, which are characterized by an extremely high capacity and a large number of separating operations, and large letters, parcels and packages are sorted by other machines, specifically designed for the respective spectrum of items. There are problems here in the following aspects:

Typically, different levels of sorting are achieved for the different classes of mailing, for example, letters are sorted, to a very fine degree, to the route sequence, whereas large letters are sorted only to an approximate degree, to the mail carrier, which has manual re-sorting as a consequence. One of the reasons for this is that, owing to the size of large letters, parcels and packages, sorting machines for a high number of separating operations, as in the case of letters, would be much too large and complex.

The delivery of mailings to the recipient is typically performed not by separate mail carriers, but together, that is to say the mailings of different mailing classes must be brought together again for delivery. This also requires laborious manual processing.

A large number of machines for sorting mailings, which differ in particular in one or more of the following characteristics, are known:

processable spectrum of mailings (dimensions, weight, material, flexibility . . . );

number and capacity of the separating operations (for example large number of small compartments, small number of large compartments);

dimensions of the machines (compact designs for small spaces, large machines for example for packages);

additional functions (setting upright, aligning, canceling postage stamps etc.)

special sorting strategies (for example route-sequence sorting in a number of machine runs).

The distribution of mailings in a distribution system with the aid of sorting machines generally takes place in a multistage operation. For instance, the Post Office handles mailings as follows In the outgoing post office the mailings are mechanically sorted for the first time, with the recipient addresses being scanned, and the addressees automatically determined by means of an OCR (Optical Character Reader) reader or by video coding, and with this distribution information being applied to the surface of the mailing in the form of a code. The sorting level is chosen such that sorting in the outgoing office can be performed appropriately for the incoming office or for a sorting plan within the incoming office.

The mailings are then transported to the incoming office.

In the incoming office, the mailings are mechanically sorted once again, to be precise to a sorting level which identifies the mail carrier.

To save the mail carrier additional sorting to delivery points, an automatic route-sequence sorting may also be performed.

Large letters are, for example, processed separately from the letters on other machines, to be precise in the same steps but not to the maximum sorting level with the route sequence.

There is a known process in which cards provided with machine-readable and visually readable code numbers are arranged in an issuing box between order bags, which bear machine-readable order numbers. In this case, however, the cards serve only as separating cards between order bags of different order groups, the order numbers of the order bags of this group, read in by machine, being assigned to the read-in separating-card numbers by a computer. If a customer comes with a specific order number, the order bag with the same order number no longer has to be laboriously found in the stack, but instead the number of the card behind which, and optionally at which point, the bag sought is located is output by the computer (see, e.g., DE 44 07 559 A1).

Furthermore, according to DE 34 23 514 A1, in a sorting process for film slides, easily identifiable dummy slides are used for marking the boundaries between groups of slides sorted according to any desired classification.

However, this printed document does not disclose any suggestion of the automatic sorting of different mailings by sorting machines which are suitable for only one type of mailing.

The invention is thus based on the object of providing a process which accomplishes a sorting of different mailings with the aid of sorting machines which are suitable only for one specific type of mailing. In particular, mailings having different properties are to be sorted to the maximum sorting level, for example route-sequence sorting for the mail carrier.

SUMMARY OF THE INVENTION

The above object generally is achieved according to the present invention by a process that is generally according to DE 196 50 875 for sorting mail or mailings having different properties by using sorting machines that sense the distribution information located on the mailings, with the process comprising: when using sorting machines not suitable for all properties of the mailings, providing unsuitable mailings with an identification marking (ID marking), and sensing the distribution information of the unsuitable mailing and storing the sensed distribution information under the relevant ID marking; adding a processible substitute to a stack of processible mailings to be sorted, with each substitute being assigned to a respective one of the non-processible mailings as representing each non-processible mailing, and in each case by the ID marking: sorting the processible mailings and the substitutes according to the associated distribution information, and, after sorting, bringing the non-processible mailings into a sequence appropriate for sorting on the basis of the ID markings located on them and the associated substitutes. Advantageous developments and modifications are disclosed and specified in the application. The invention thus allows an equally high sorting level of all types of mailing, although only sorting machines which are not suitable for all types of mailing are available or used for this purpose. In addition, the bringing together of different mailings can be performed for the mail carrier without great effort.

The following advantages are achieved as a result:

there is no longer any need to procure sorting machines for fine sorting for specific spectra of items;

there is no longer any need for manual fine sorting of larger items;

there is no longer any need for mixing stacks of fine-sorted mailings of different spectra of items to form a stack of fine-sorted mailings of a number of spectra of items, or this comprises part of the process described and is made considerably easier by the marking.

In comparison with the process disclosed in German patent No. DE 19650875 discussed above, the solution according to the invention has the following advantages:

1. The mailings which cannot be processed and the assigned substitutes may also have different ID markings. As a result, reusable substitutes provided with ID markings can be used.
2. After the sorting operation, the mail carrier, for example, takes a substitute at random from the sorted stack of mailings, reads the printed-on ID marking and takes from the stack of non-processable mailings, advantageously ordered according to ID markings, the mailing with the same ID marking or the ID marking of the assigned mailing if they have different ID markings, which he has determined by means of an inquiry to the machine control system, in which the assignments are stored.

Then he can, as specified in the prior process, sort this mailing into the sorted stack of mailings in place of the substitute taken, or he positions it according to the address in a separate container for non-processable mailings.

The distribution information obtained before the sorting according to the invention, for example, the recipient addresses in the case of a first sorting of a low sorting level on different sorting machines in the outgoing post office, is advantageously transferred to the control systems of the sorting machines which sort the mailings and the substitutes. This transfer is favorably performed via data networks.

The substitutes, advantageously in the form of colored cards, have at least ID markings which are applied, at the latest, in the machines sorting the substitutes. If reusable substitutes are used, each substitute has a fixed ID marking. If the evaluation of the ID information on substitutes is carried out by a person, such codes must be man-readable.

If the evaluation is carried out by a reading unit, the ID code may be purely machine-readable. The reading unit can then convert the ID information into a man-readable form or make it available for automatic further processing by machine.

In the case of the non-reusable substitutes, it is possible to apply, along with the ID markings, also the coded distribution information. In this case, any sorting operations which may follow for the letters and substitutes can be performed without a databank.

Since sorting is often on the basis of the delivery district, it is favorable to use a consecutive number beginning anew for each delivery district for the ID marking. To rule out subsequent mix-ups, it is advantageous for ID marking to apply, along with the consecutive number, also a delivery district identification.

The invention is explained in more detail below in exemplary embodiments with letters and large letters to be sorted.

DETAILED DESCRIPTION OF THE PREFERRED EMBODIMENTS

Figure 1:
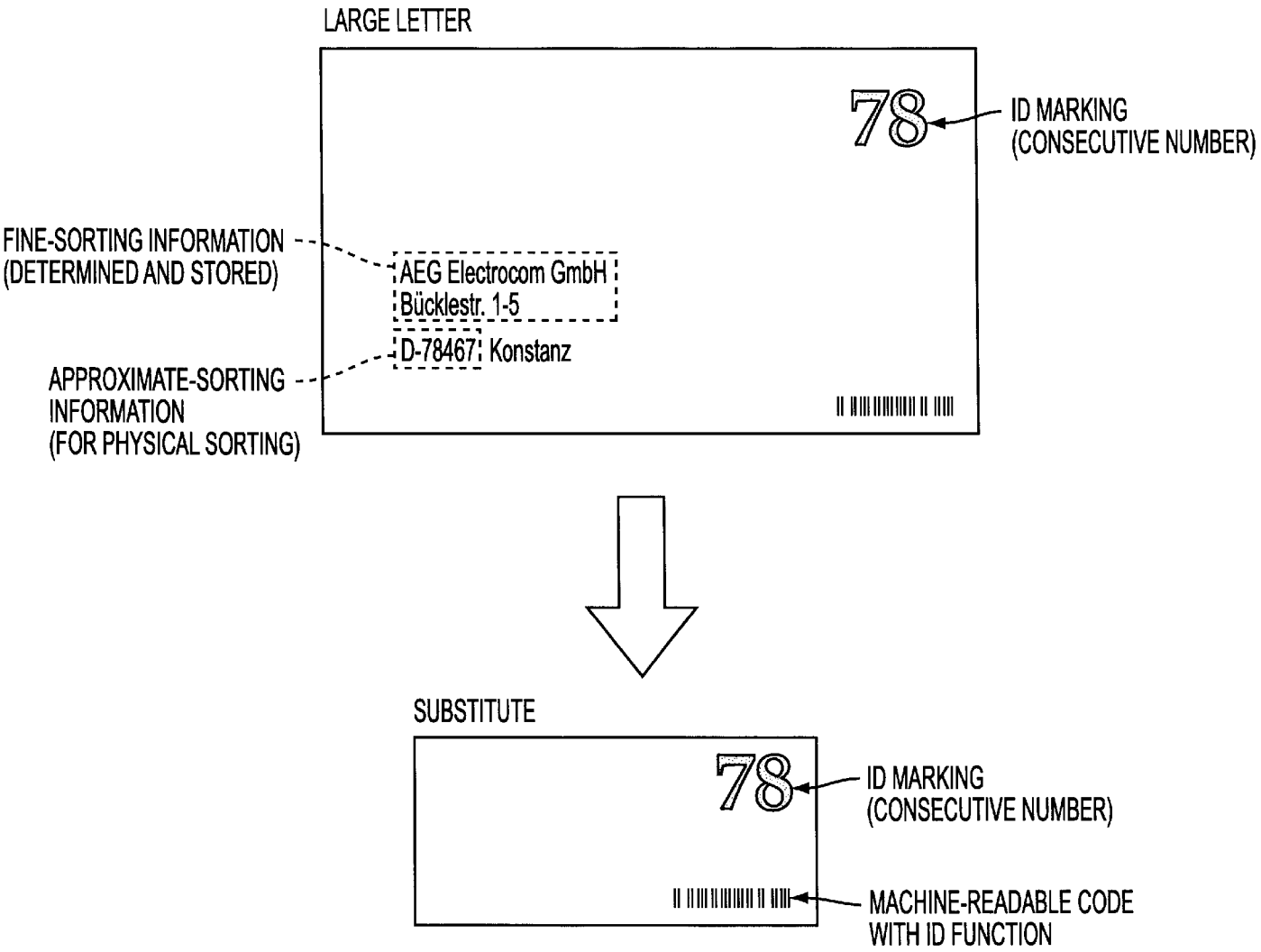
FIG. 1 shows a large letter and an associated substitute with ID marking

In the outgoing post office, the letters and large letters are mechanically sorted for the first time on different sorters, which the recipient addresses being scanned, the addressees automatically determined by means of an OCR reader or by video coding and this distribution information being applied to the surface of the mailing in the form of a code. The sorting level is chosen such that sorting in the outgoing office can be performed appropriately for the incoming office or for a sorting plan within the incoming office. After transporting to the incoming office, the mailings are again mechanically sorted, separately for a mail carrier or a group of mail carriers.

Subsequently, a route-sequence sorting is performed for the individual mail carriers/mail carrier groups on sorting machines suitable only for letters or cards. In order that the large letters can be included in this route-sequence sorting, the following procedure is adopted:

Step 1

In the sorting of the large letters in the outgoing or incoming office, the letters are clearly marked for each delivery district by an ID marking, for example advantageously by printing on a machine-readable number in ascending sequence. Example: if a sequence of 10 large letters for which the mail carrier has been determined according to the following table is being processed, the numbers indicated in Table 1 are printed on. After sorting on the basis of mail carriers, the mailings of each and every mail carrier leave the sorting machine with ascending numbers.

Furthermore, the sorting information for each large letter of each mail carrier is stored with respect to the ID marking, as indicated in the right-hand column. This sorting information must be detailed enough for a route-sequence sorting to be possible. This is indicated in the table by the sorting information to be stored including details which go beyond the mail-carrier number.

| Large-letter No. | Mail-carrier No. | No. to be printed on | Stored sorting information |
|---|---|---|---|
| 1 | 17 | 1 | Hauptstr. 20 |
| 2 | 5 | 1 | Nelkenweg 3 |
| 3 | 9 | 1 | Steinstr. 40 |
| 4 | 17 | 2 | Hauptstr. 19 |
| 5 | 5 | 2 | Nelkenweg 8 |
| 6 | 17 | 3 | Hauptstr. 28 |
| 7 | 5 | 3 | Nelkenweg 5 |
| 8 | 17 | 4 | Hauptstr. 51 |
| 9 | 9 | 2 | Steinstr. 6 |
| 10 | 17 | 5 | Hauptstr. 40 |

Step 2

Before the route-sequence sorting, substitutes for all large letters which are to go to the same mail carrier are added to the letters of each mail carrier. These substitutes may be prefabricated cards of striking colors, which can be mechanically sorted together with the letters and bear a code for clear, machine-readable identification and also bear ascending numbers in man-readable form. Alternatively, these cards may also be unmarked and provided with the man-readable marking and a machine-readable code by the sorting machine only in step 3.

Step 3

For the letters of each mail carrier, the mechanical route-sequence sorting is carried out. If a substitute is processed in this sorting, it may be assigned on the basis of the code applied. The associated sorting information is available from the data stored from the large-letter sorting (assuming data transfer from the large-letter sorting machine to the route-sequence sorting machine) and makes possible a route-sequence sorting of the substitute. The substitute may thus be sorted as representing the large letter on the letter-sorting machine, together with the letters, with the same sorting level as the letters. If the substitute (as mentioned under step 2) is still unprinted or has only partially been printed on, it may be assigned by the machine to a large letter and then be correspondingly printed on.

Step 4

After ending the route-sequence sorting, the mail carrier replaces each substitute with the associated large letter, or he sorts the large letters separately on the basis of the sorted substitutes. This work is less laborious, since the substitutes can be easily found by their striking color and/or shape, bear the same man-readable numbers as the large letters, and the large letters have already been sorted by numbers! To be specific, the mail carrier takes a substitute at random from the sorted stack of letters, reads the number, takes its counterpart from the stack of large letters sorted by numbers and adds it to the stack of letters (or positions it in a special container separately from the stack of letters).

FIG. 1 shows at the top an exemplary embodiment of a large letter printed with the required man-readable marking with the recipient's address, comprising outgoing information (zip code) and the incoming information for fine sorting and provided with a bar code for mechanical processing. FIG. 1 shows at the bottom the associated substitute, which bears the same man-readable marking, and also a bar code for the clear mechanical identification of the substitute.

Figure 2:
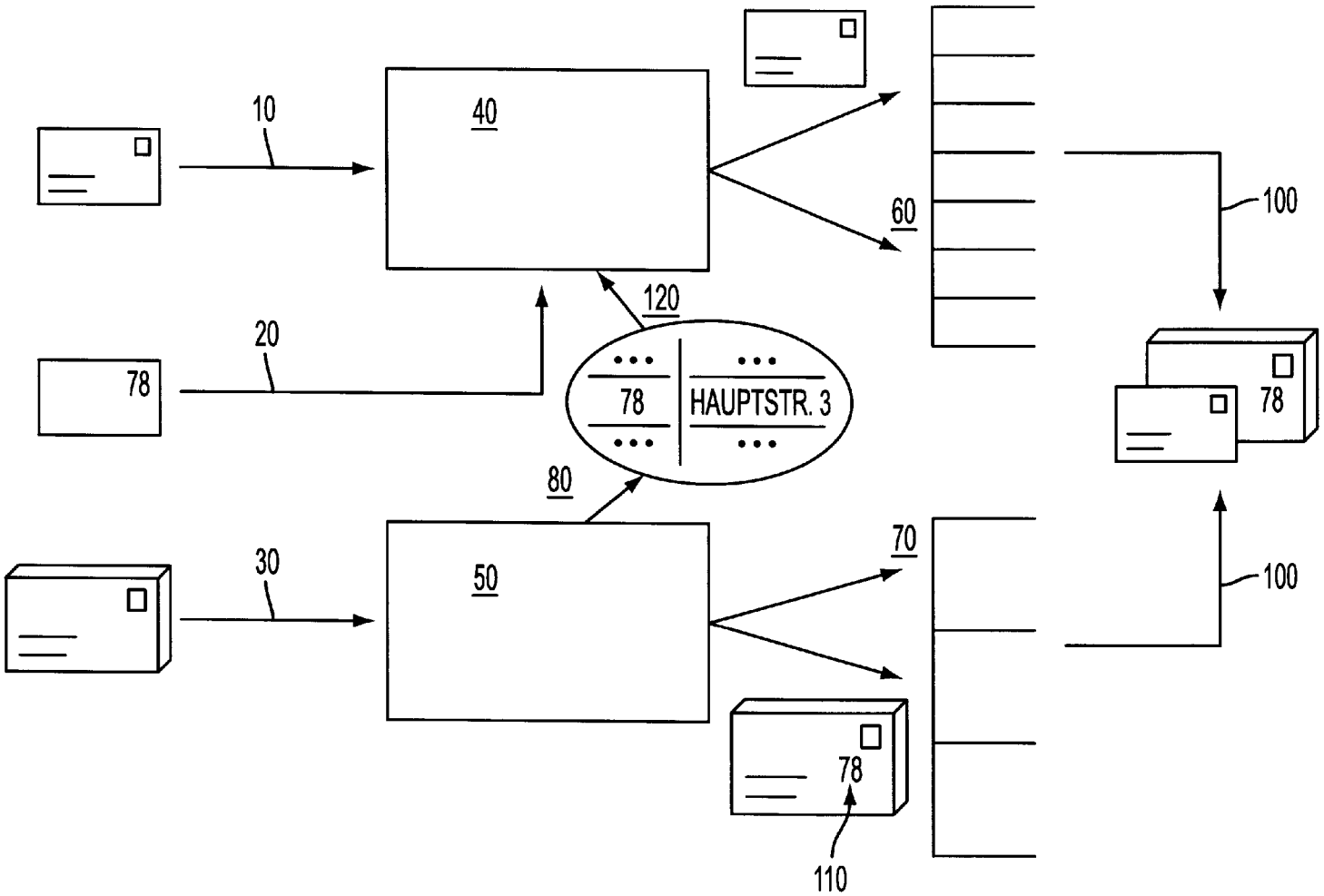
FIG. 2 shows a schematic representation of the process sequence in route-sequence sorting with matching ID markings on the non-processable mailings and assigned substitutes and FIG. 3 shows a schematic representation of the process sequence, in which the ID markings of the non-processable mailings and the assigned substitutes do not match.

FIG. 2 shows an overview of the 4 process steps described above:

1. A stream of large letters 30 is sorted into bins or stacks 70, by means of sorting machines 50 in one or more sorting operations to a certain sorting level. The large letters are thereby provided with a man-readable ID marking 110, and the distribution information for each large letter is stored as indicated by reference numeral 80.
2. A stream of letters 10 is sorted in bins or stacks of 60, by means of other sorting machines 40 in one or more sorting operations to a sorting level which is finer than that of the large letters at 70. Substitutes 20 for each marked large letter 30 are introduced into the sorting of the letters.
3. These substitutes 20 are sorted at 60, together with the letters 10. The substitutes 20 are distinguished here on the basis of the ID markings applied to the surface, and the distribution information is taken from the memory, 120.
4. After sorting of the letters and substitutes has been performed, the large letters 30 and the letters 10 are brought together to form an overall sorted stream 100 by the substitutes 20 being replaced by the large letters.

Exemplary Embodiment 2

In another exemplary embodiment, not the same but different ID markings are applied to the large letters and the substitutes. Furthermore, the substitutes are not replaced by the large letters in the stream of letters once sorting has been performed, but instead the large letters are sorted in their own containers on the basis of the substitutes which have been sorted. The exemplary embodiment is not based on the specific task of route-sequence sorting. The 4 process steps then take the following form:

Step 1

In the sorting of the large letters, they are clearly marked by applying a machine-readable ID code and/or a man-readable ID marking. As already described in exemplary embodiment 1, the sorting information which makes the desired sorting level possible is determined for each large letter. However, the large letters are initially not sorted to this sorting level. The sorting information for each large letter is stored and is clearly assigned to the large letter by means of the ID marking.

Step 2

Before the sorting of the letters, substitutes for all the large letters are added to the stream of letters. These substitutes may be prefabricated cards of striking colors, which can be mechanically sorted together with the letters and bear a code for clear, machine-readable identification, which does not have to match the ID marking of the large letters. Alternatively, these cards may also be unmarked and provided with a man- and/or machine-readable marking, which in turn does not have to match the marking of the large letters, by the sorting machine only in step 3.

Step 3

The letters are sorted together with the substitutes. If a substitute is processed in this sorting, it is clearly assigned to a large letter on the basis of the code applied or now to be applied. The associated sorting information is available from the data stored from the large-letter sorting (assuming data transfer from the large-letter sorting machine to the route-sequence sorting) and makes the sorting of the substitute possible. The substitute may thus be sorted as representing the large letter on the letter-sorting machine, together with the letters, with the same sorting level as the letters. If the substitute (as mentioned under step 2) is still unprinted or has only been partially printed on, it is assigned by the machine to a large letter and then correspondingly printed on.

Step 4

After ending the sorting, the large letters can be sorted on the basis of the substitutes inserted in sorted form into the stream of letters. For this purpose, the ID information is taken from the substitute, to be precise directly by the person (assuming man-readable marking of the substitute) or by a reading unit, then the associated large letter is determined on the basis of the databases, in which each large letter with ID marking and address is assigned a substitute with its own ID marking, and finally the large letter is found and sorted on the basis of its marking. This task is less laborious, since the substitutes can be easily found by their striking color and/or shape, and the large letters have already been sorted by ID markings! To give a specific example of this: the operator takes a substitute from the sorted stack of letters, has the code located on it decoded by a code-reading unit and has the ID marking of the associated large letter indicated on a display. He then takes its counterpart from the stack of large letters sorted by man-readable ID markings and establishes a sorting of the large letters by repeating these steps.

Figure 3:
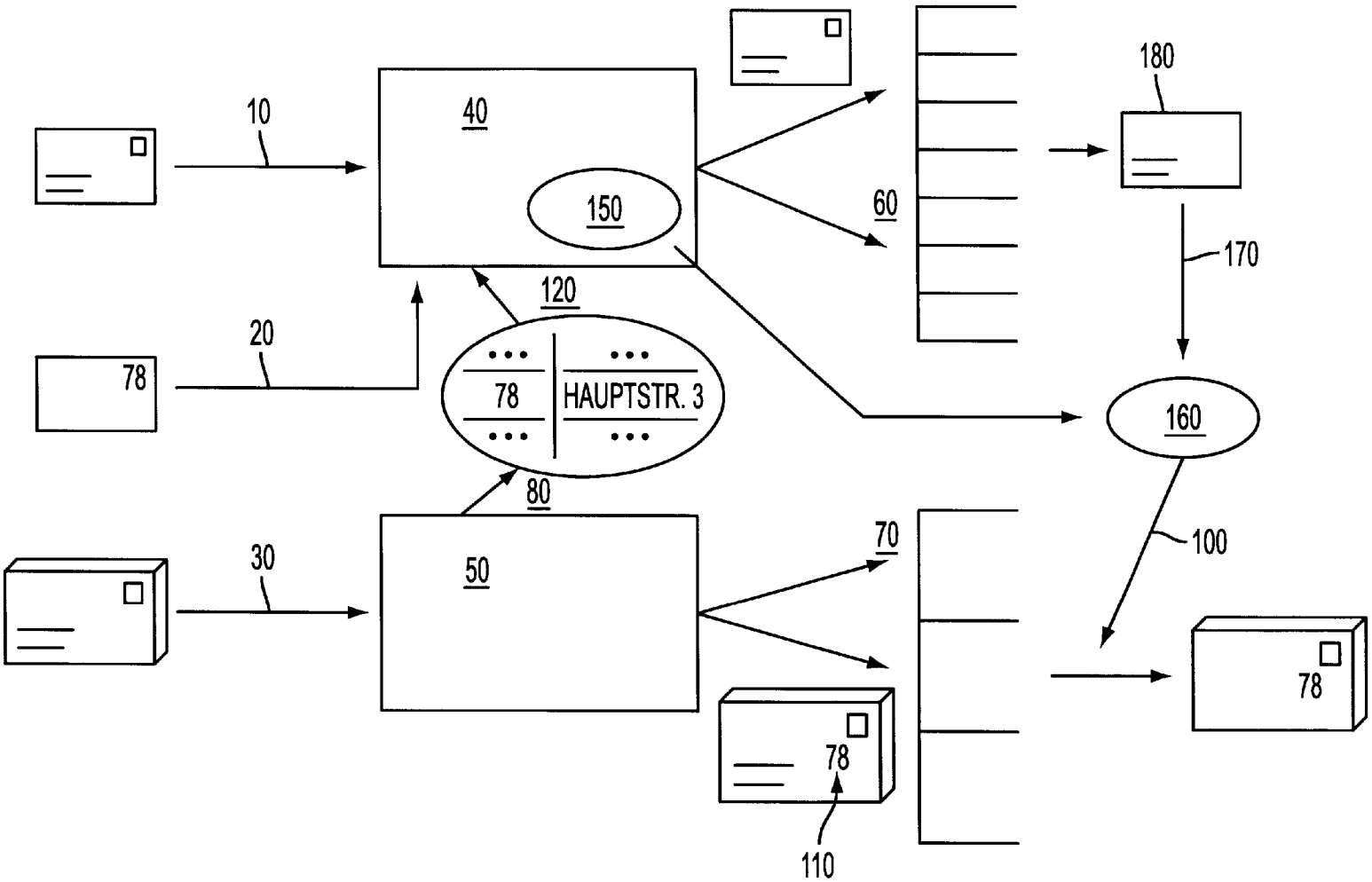

FIG. 3 shows an overview of the 4 process steps described above:

1. A stream of large letters 30 is sorted into bins or stacks 70, by machines 50 in one or more sorting operations to a certain sorting level. The large letters 30 are thereby provided with a (man- or machine-readable) marking 110, and the sorting information for each large letter is stored as indicated by reference numeral 80.

2. A stream of letters 10 is sorted into bins or stacks 60, by machines 40 in one or more sorting operations to a sorting level which is finer than that of the large letters, 70. Substitutes 20 for each marked large letter 30 are introduced into the sorting of the letters.

3. These substitutes are sorted into stacks or bins 60, together with the letters 10. The substitutes 20 are distinguished here on the basis of the markings applied to the surface, and the sorting information is taken from the memory as indicated by reference numeral 120. For this purpose, an assignment list of the ID markings of the large letters 30 with respect to the markings of the substitutes 20 is stored in the databases 150 of the sorting machine.

4. After sorting of the letters 10 and substitutes 20 has been performed, the large letters 30 are sorted on the basis of the sorting provided by the substitutes 20. The ID marking of one of the substitutes 180 must be read off, as indicated by reference numeral 170, for this purpose and assigned, in device 160, to the ID marking of the large letters 30 on the basis of the stored data. With the then known marking 100 of the associated large letter, the latter is then found and sorted. In the sorting of the large letters, they do not necessarily have to be brought together physically with the letters.

What is claimed is:

1. A process for sorting mailings having different properties by using sorting machines which sense distribution information located on the mailings, comprising:

when using sorting machines not suitable for all properties of the mailings, providing unsuitable mailings with an identification marking (ID marking), and sensing the distribution information of the unsuitable mailing and storing the sensed distribution information under the relevant ID marking, as representing each non-processible mailing, adding a prosecutable substitute to a stack of prosecutable mailings to be sorted, with each substitute being assigned one of the non-processible mailings, in each case by an ID marking, sorting, the processable mailings and the substitutes according to the associated distribution information, and, after sorting, bringing the non-processable mailings into a sequence appropriate for sorting on the basis of the ID markings located on them and the associated substitutes.

2. The process as claimed in claim 1, wherein the ID marking of the respective non-processable mailing and of the substitute assigned to it match.

3. The process as claimed in claim 1, wherein the non-processable mailings and the substitutes have different ID markings and each non-processable mailing is assigned a specific substitute.

4. The process as claimed in claim 1, wherein the distribution information of the non-processable mailings which has been sensed and assigned to the ID markings is transferred to the control system of the sorting machine.

5. The process as claimed in claim 1, wherein the distribution information of the substitutes is determined by reading their ID marking and and comparing read ID markings with a list of the distribution information of the non-processable mailings stored under the assigned ID markings.

6. The process as claimed in claim 1, wherein, along with the ID marking, the distribution information of the respectively associated non-processable mailing is applied to the substitutes.

7. The process as claimed in claim 1, wherein the ID marking comprises a consecutive number beginning anew for each delivery district.

8. The process as claimed in claim 7, wherein the ID marking comprises a delivery district code and a consecutive number beginning anew for each delivery district.

9. The process as claimed in claim 1 wherein one of the ID marking, and the ID marking and the distribution information is applied to the substitutes in one of a coded form and a form which can be read by a person.

10. The process as claimed in claim 1, wherein the distribution information of the substitutes is determined by reading distribution information located on these substitutes.

11. The process as claimed in claim 1, wherein the substitutes are designed in such a way that they are clearly distinguishable from the processable mailings.

12. The process as claimed in claim 1, wherein the ID markings of the substitutes are only applied during the processing in the sorting machines.

13. The process as claimed in claim 1, wherein the substitutes are reusable and have a fixed ID marking.

14. The process as claimed in claim 1, characterized in that, after sorting, the substitutes are exchanged in the sorted stack for the assigned non-processable mailings.

15. The process as claimed in claim 1, wherein, after sorting, the non-processable mailings are sorted on the basis of the sorted substitutes separately from the processed mailings.

* * * * *